US007992576B2

(12) United States Patent
Chang

(10) Patent No.: US 7,992,576 B2
(45) Date of Patent: Aug. 9, 2011

(54) HAIR EXTENSION KIT AND EXTENSION-HAIR FIXING METHOD

(75) Inventor: In-Young Chang, Seoul (KR)

(73) Assignee: Joo San Co., Ltd., Seoul (KR)

( * ) Notice: Subject to any disclaimer, the term of this patent is extended or adjusted under 35 U.S.C. 154(b) by 361 days.

(21) Appl. No.: 12/225,343

(22) PCT Filed: Mar. 30, 2007

(86) PCT No.: PCT/KR2007/001553

§ 371 (c)(1),
(2), (4) Date: Sep. 19, 2008

(87) PCT Pub. No.: WO2007/123308

PCT Pub. Date: Nov. 1, 2007

(65) Prior Publication Data

US 2010/0154815 A1 Jun. 24, 2010

(30) Foreign Application Priority Data

Apr. 26, 2006 (KR) ..... 10-2006-0037425

(51) Int. Cl.
*A41G 3/00* (2006.01)
*A41H 43/00* (2006.01)

(52) U.S. Cl. ..... 132/201; 132/53; 223/48

(58) Field of Classification Search ..... 132/201, 132/53–56, 200, 203, 207, 210, 212, 273; D28/92, 39, 10; 66/3, 117, 118; 112/224, 112/225; 223/99, 48; 54/75, 76, 78, 1
See application file for complete search history.

(56) References Cited

U.S. PATENT DOCUMENTS

| | | | | |
|---|---|---|---|---|
| 5,775,341 | A * | 7/1998 | Abe et al. | 132/201 |
| 5,967,151 | A * | 10/1999 | Villani et al. | 132/200 |
| 7,032,602 | B2 * | 4/2006 | Chang | 132/53 |
| 7,753,057 | B2 * | 7/2010 | Kallabat et al. | 132/201 |
| 2005/0011530 | A1 | 1/2005 | Chang | |
| 2005/0098190 | A1 * | 5/2005 | Kim | 132/201 |
| 2005/0155619 | A1 * | 7/2005 | Lane et al. | 132/201 |

(Continued)

FOREIGN PATENT DOCUMENTS

CN 01274489.1 12/2002

(Continued)

OTHER PUBLICATIONS

International Search Report.
Protest Under Section 10 of Patent Rules filed by Global Best Beauty Trading Ltd. of Toronto, Ontario against Canadian Patent Application No. 2,649,096, filed May 11, 2010.

*Primary Examiner* — Todd E Manahan
*Assistant Examiner* — Vanitha Elgart
(74) *Attorney, Agent, or Firm* — Collard & Roe, P.C.

(57) ABSTRACT

A hair extension kit enables user's hair to be coupled with extended hairs, and includes a fastening ring formed in a hollow shape, each respective upper end of the extended hairs being attached to an inner peripheral surface of the fastening ring; a guiding loop having a portion thereof received in the fastening ring and a guiding and holding part formed at the lower end thereof, the guiding loop being removable from the fastening ring; and a drawing loop having a portion thereof received between an inner wall of the fastening ring and the corresponding part of the guiding loop and a drawing and holding part formed at the lower end thereof, the drawing loop being removable from the fastening ring. The hair extension kit can increase the coupling force between the user's hair and the extension-hair via the fastening ring.

5 Claims, 6 Drawing Sheets

U.S. PATENT DOCUMENTS

| | | | | |
|---|---|---|---|---|
| 2006/0065281 | A1* | 3/2006 | Kim | 132/201 |
| 2006/0180171 | A1* | 8/2006 | Kim | 132/201 |
| 2008/0236605 | A1* | 10/2008 | Russo | 132/201 |
| 2008/0276949 | A1* | 11/2008 | Lee | 132/53 |
| 2009/0071492 | A1* | 3/2009 | Oh | 132/201 |
| 2010/0006115 | A1* | 1/2010 | Croes-Stoffer | 132/54 |
| 2010/0059079 | A1* | 3/2010 | Tokko | 132/201 |

FOREIGN PATENT DOCUMENTS

| | | |
|---|---|---|
| CN | 200420088814.7 | 9/2005 |
| JP | 2004-323985 | 11/2004 |
| KR | 316 019 | 6/2003 |
| KR | 333 865 | 11/2003 |
| KR | 10-2005-0102981 | 10/2005 |

* cited by examiner

HAIR EXTENSION KIT AND EXTENSION-HAIR FIXING METHOD

CROSS REFERENCE TO RELATED APPLICATIONS

This application is the National Stage of PCT/KR2007/001553 filed on Mar. 30, 2007, which claims priority under 35 U.S.C. §119 of Korean Application No. 10-2006-0037425 filed on Apr. 26, 2006. The international application under PCT article 21(2) was published in English.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable INCORPORATION BY REFERENCE OF MATERIAL SUBMITTED ON A COMPACT DISC
Not Applicable

BACKGROUND OF THE INVENTION (1) Field of the Invention

The present invention relates to a hair extension kit and an extension-hair fixing method which can replenish a thin haired human with hairs or rendering a more natural hair style by making short hair long. More particularly, the present invention relates to a hair extension kit and an extension-hair fixing method which can increase a coupling force between an extension-hair and user's hair by inserting a guiding loop and a drawing loop into a fastening ring with extended hairs attached to the inner peripheral surface thereof (herein, an assembly of the extended hair and the fastening ring is referred to as extension-hair), winding the user's hair around the fastening ring using the two loops, and then compressing or bending the fastening ring, and further preventing the extension-hair from slipping down or falling out from the user's hair.

(2) Prior Art

Recently, as women have been interested in their appearance and beauty, various accessories or stuffs are being developed. Especially, in hairdressing and other beauty treatment, hair styling showing individual characters by changing a hair style and hair color, such as hair dyeing, is widely used.

Particularly, in recent years, partial wigs using original hair or synthetic hair are acquiring a greater vogue than hairstyling or coloring, for instance, short hair is made long utilizing various kinds of partial wigs, or a bridge type partial wig is made utilizing a pre-colored state of partial wigs.

As mentioned above, in case of making short hair long, an extension-hair made of human hair or synthetic hair is used. If it is desired to connect an extended hair to a user's hair, a predetermined number of an extended hair are taken out from extended hairs stacked on a work table, an adhesive is applied to the end of the extended hair, and then the extended hair is attached to the end of hair desired to be connected, thereby the user's hair and the extended hair is connected by the medium of the adhesive.

In that case, the adhesive melted by an intense heat is applied in overlapped part of the extended hair end and the user's hair end, and then as the adhesive starts to be hardened, a hairdresser makes a roll of the adhesive directly with fingers to form it round and solidify it.

However, a technique of the typical extension-hair as above stated is a manner that a certain amount of the extended hair is taken out of extended hairs stacked on the work table. Thus there are a lot of hairs dropping on the floor or falling around, so it is not economical. Moreover, also the number of the hairs is not in constant, this makes it difficult to expect a high quality of a beauty state.

Especially, in a case that the user's hair and the extended hair are connected using a liquid adhesive injecting device, the applied amount of the liquid adhesive is not constant, thus the size of the resulting adhered part is not constant as well as the operation is so messy. Further, a technique of coating the liquid adhesive on the ends of the certain amount of the extended hair needs an intense heat directly applied to the user's hair in order to melt the hardened adhesive when an adhered state of the user's hair and the extended hair is sometime to be released, so this may lead to the damage to the hair as well as the risk of burning. In addition, the melted adhesive flows down or makes the operation messy.

To overcome the above-described problem, the present applicant had registered an extension-hair in Korean Utility Model Registration No. 316019 and Korean Utility Model Registration. No. 333865, which disclose an extension-hair which fastens user's hair and the extended hair to each other by pressurizing a contraction tube or a connection ring after passing user's hair through the contraction tube or the connection ring, with a certain amount of extended hair being adhered in advance to the contraction tube or the connection tube or the like.

The extension-hair includes a drawing loop and a guiding loop, and each of the loops is used so that the user's hair can pass easily through the contraction tube or the connection ring.

However, the aforementioned extension-hair has such a structure that the user's hair is inserted through the contraction tube or the connection ring. Thus, there is a problem that if the compression force is weak due to the contraction of the contraction tube or a bending and fastening force of the connection ring is weak, the extension-hair slips down or falls out from the user's hair.

Particularly, user's hair has a certain degree of oil content, thus the coupling force becomes weaker because the frictional force to all kinds of hair is reduced due to the oil content. Further, if a practitioner applies the extension-hair with a weak fastening force in the process of application of the extension-hair, the fastening force of the extension-hair become's more weakened.

Moreover, if a considerable pull force is applied to the extension-hair due to combing or an unexpected problem, there is a risk that the extension-hair with the weak fastening force may slip down or fall out from the user's hair in most cases. Further, a customer who has paid a high price for the application of an extension-hair may feel quite unpleasant if even one extension-hair falls out from the user's hair.

BRIEF SUMMARY OF THE INVENTION

Therefore, the present invention has been made to solve the above-mentioned problems, and an object of the present invention is to provide a hair extension kit and an extension-hair fixing method, which can increase a coupling force between user's hair and extension-hair through a fastening ring, thereby preventing the extension-hair from slipping down or falling out from the user's hair even if a physical pull force is applied thereto or oil content of user's hair is increased.

Another object of the present invention is to provide a hair extension kit and an extension-hair fixing method, which can conceal the outer side of the fastening ring by winding the user's hair around the inner and outer peripheral surfaces of the fastening ring, thereby rendering a more natural hair style with the extension-hair and the user's hair.

In order to accomplish the above-mentioned objects, the present invention provides a hair extension kit enabling user's hair to be coupled with extended hairs, which includes a fastening ring formed in a hollow shape, each upper ends of the extended hairs being attached to the inner peripheral surface of the fastening ring; a guiding loop having a portion thereof received in the fastening ring and a guiding and holding part formed at the lower end thereof, the guiding loop being removable from the fastening ring; and a drawing loop having a portion thereof received between an inner wall of the fastening ring and the corresponding part of the guiding loop and a drawing and holding part formed at the lower end thereof, the drawing loop being removable from the fastening ring. Herein, an assembly of the extended hair and the fastening ring is referred to as "extension-hair". In addition, the present invention provides the following detailed embodiments in conjunction with the above-mentioned embodiment.

According to an embodiment of the present invention, the fastening ring is deformable by an external force so as to increase the coupling force between the user's hair and the extended hair in a state that the guiding loop and the drawing loop are removed from the fastening ring, respectively.

According to the embodiment of the present invention, each of the lower portions of the guiding loop and the drawing loop is twisted with a predetermined number of windings.

In another aspect of the present invention, there is provided an extension-hair fixing method, which comprises the steps of: inserting user's hair into a guiding loop, and drawing the user's hair downwardly through a fastening ring using a guiding and holding part of the guiding loop; penetrating the user's hair through the drawing loop in order to allow the user's hair to wrap around an outer peripheral surface of the fastening ring using the guiding loop, and removing the guiding loop from the user's hair; and drawing down the user's hair through the fastening ring using a drawing and holding part of the drawing loop, and removing the drawing loop from the user's hair.

In addition, the present invention further provides the following detailed embodiment in conjunction with the above-mentioned embodiment.

According to an embodiment of the present invention, the extension-hair fixing method further comprises the step of deforming the fastening ring by an external force so as to increase the coupling force between the user's hair and the extended hair.

BRIEF DESCRIPTION OF THE SEVERAL VIEWS OF THE DRAWINGS

The above objects, other features and advantages of the present invention will become more apparent by describing the preferred embodiments thereof with reference to the accompanying drawings, in which:

FIGS. 3 to 7 are perspective views showing a used state of an hair extension kit according to the exemplary embodiment of present invention, wherein FIG. 3 is a perspective view of user's hair inserted into a loop portion of a guiding loop protruding above a fastening ring, FIG. 4 is a perspective view of the guiding loop and the user's hair drawn down the fastening ring, FIG. 5 is a perspective view of the drawn guiding loop and the user's hair inserted into a loop portion of a drawing loop, FIG. 6 is a perspective view of the drawing loop and the user's hair being drawn down the fastening ring when the guiding loop is removed, and FIG. 7 is a perspective view of the user's hair wound around the inner and outer peripheral surfaces of the fastening ring and the extended hair being fastened by the compression of the fastening ring;

DETAILED DESCRIPTION OF THE INVENTION INCLUDING THE BEST MODE

Hereinafter, preferred embodiments of the present invention will now be described in detail with reference to FIGS. 1, 2 and 9.

Figure 1:
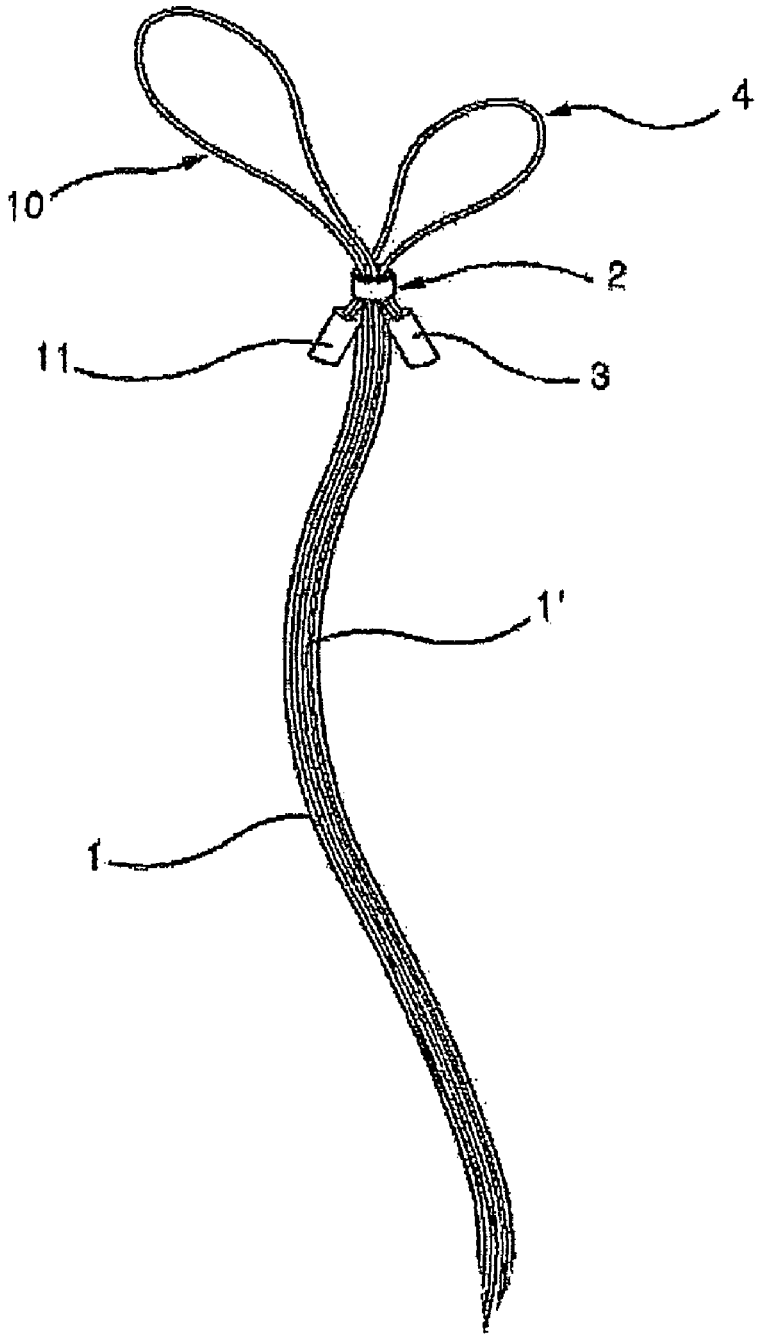
FIG. 1 is a perspective view showing a schematic construction of a hair extension kit according to an exemplary embodiment of the present invention.
Figure 2:
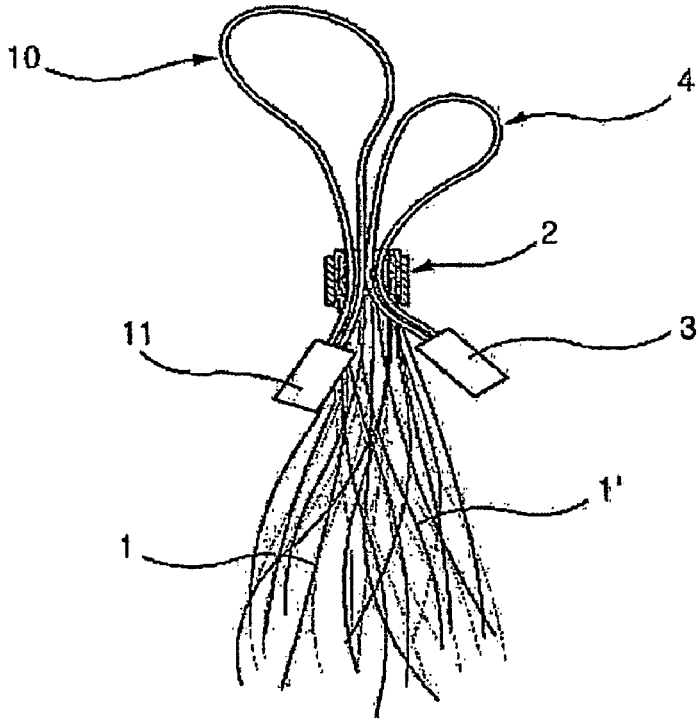
FIG. 2 is an enlarged sectional view showing the main parts of the hair extension kit according to the exemplary embodiment of the present invention.

FIG. 1 is a perspective view showing a schematic construction of a hair extension kit according to an exemplary embodiment of the present invention, FIG. 2 is an enlarged sectional view showing the main parts of the hair extension kit according to the exemplary embodiment of the present invention.

As shown in FIGS. 1 and 2, the hair extension kit according to the exemplary embodiment of the present invention largely includes a fastening ring 2 having a hollow shape, a guiding loop 4 and a drawing loop 10.

Herein, the fastening ring 2 is formed in a hollow shape capable of fastening extended hairs 1 and 1', and each upper ends of the extended hairs 1 and 1' are attached to the inner peripheral surface of the fastening ring 2. The fastening ring 2 serves to not only fasten the extended hairs 1 and 1' but also firmly couple the extended hairs 1 and 1' of the fastening ring 2 with user's hair 12 after inserting it into the user's hair 12 in the future.

The guiding loop 4 having a portion thereof received in the fastening ring 2, and a guiding and holding part 3 formed at lower end thereof, and removably inserted into the fastening ring 2. A loop-shaped upper portion of the guiding loop 4 is inserted through an inner part of the fastening ring 2 and protrudes towards an exterior thereof. The guiding loop 4 can be removed by drawing out the guiding and holding part 3 provided at lower end of the fastening ring 2. The guiding loop 4 also serves to allow the user's hair 12 to be drawn down through the inner part of the fastening ring 2 to the exterior thereof and then wound around the fastening ring 2.

The drawing loop 10 having a portion thereof received between an inner wall of the fastening ring 2 and the corresponding part of the guiding loop 4, and a drawing and holding part 11 formed at lower end thereof, and removably inserted into the fastening ring 2. A loop-shaped upper portion of the drawing loop 10 is inserted through an inner part of the fastening ring 2 and protrudes towards an exterior thereof. The drawing loop 10 can be removed by drawing out the drawing and holding part 11 provided at lower end of the fastening ring 2. The drawing loop 10 also serves to allow the user's hair 12 inserted through the guiding loop 4 to be drawn down through the inner part of the fastening ring 2 downward.

Meanwhile, the fastening ring 2 is provided to be deformable by an external force so as to increase the coupling force between the user's hair 12 and the extended hairs 1 and 1' in a state that the guiding loop 4 and the drawing loop 10 are removed from the fastening ring 2, respectively.

It is preferable that the fastening ring 2 is made of materials capable of being readily deformed by a predetermined external force applied by practitioners, and then continuously maintaining such a deformed state. In a preferable embodiment, the fastening ring 2 may be made of metals such as aluminum, nickel, copper, and mixture thereof.

In addition, the fastening ring 2 can be provided in various forms such as circle, cylindrical, tetragonal, C shape, etc., in consideration of the variety of articles as well as the deformability of the fastening ring 2 due to the external force. It is preferred that the fastening ring 2 has a size of such an extent that it is not easily exposed to the outside when the application is finished. The fastening ring 2 may be made of metals having the same color sense as the actual color of the extended hairs 1 and 1', or a coating layer or paint layer having the same color sense as the actual color of the extended hairs 1 and 1' may be formed on the surface of the fastening ring 2.

Meanwhile, each of the upper ends of the extended hairs 1 and 1' is attached to the inner peripheral surface of the fastening ring 2 by the medium of an adhesive or a separated attaching member (not shown). At this time, each of the upper ends of the extended hair 1 and 1' is preferably attached in such a manner that it protrudes slightly from the end of the fastening ring 2 to the exterior thereof so that it can prevent the user's hair 12 from being damaged by the end portion of the fastening ring 2.

Figure 9:
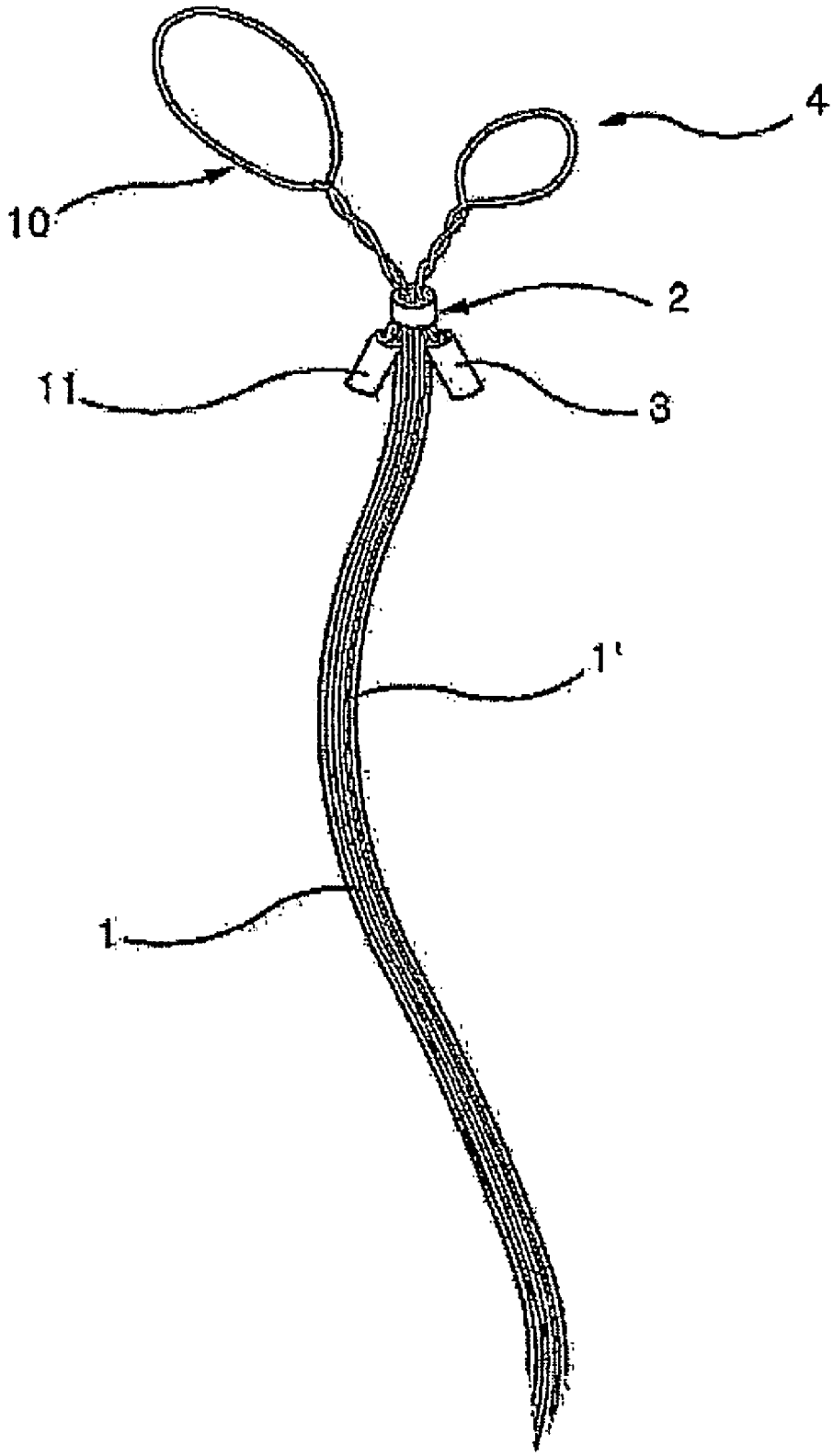
FIG. 9 is a perspective view showing a schematic construction of a hair extension kit according to another embodiment of the present invention, wherein each of the lower portions of the guiding loop and the drawing loop is twisted with a predetermined number of windings.

Moreover, in the hair extension kit according to an another embodiment of the present invention, each of the lower portions of the guiding loop 4 and the drawing loop 10, as shown in FIG. 9, may be twisted with the predetermined number of windings. In this case, the guiding loop 4 and the drawing loop 10 become stiff by means of the corresponding twisted parts so as to continuously maintain the deformed state, thereby preventing the two loops 4 and 10 from being entangled with each other in advance.

Hereinafter, using the hair extension kit having the aforementioned construction, the procedure for coupling the fastening ring having the extended hairs attached thereto with the user's hair will now be described in detail with reference to FIGS. 1 to 8.

Firstly, a plurality of hair extension kits, in which each of the guiding loop 4 and the drawing loop 10 are inserted into the fastening ring 2 having the extended hairs 1 and 1' made of a certain amount of human hair or synthetic hair are prepared (shown in FIGS. 1 and 2).

Figure 3:
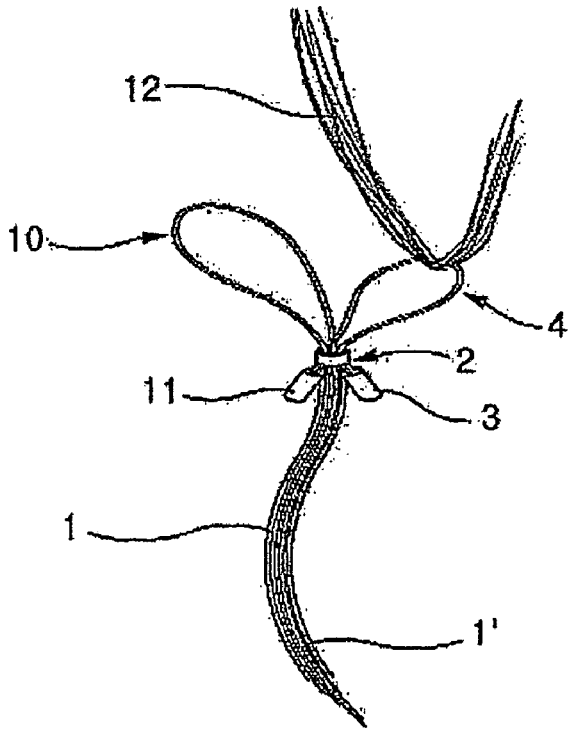
Figure 4:
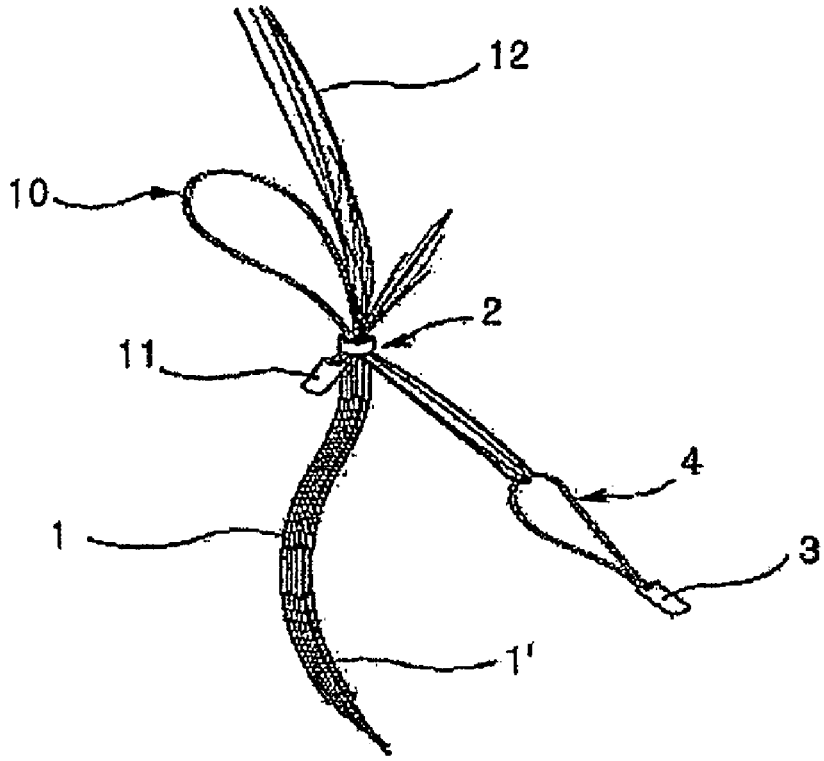

Next, in a state that a practitioner has put up the corresponding hair extension kit above the user's head where it will be applied, after inserting a certain amount of the user's hair 12 into the guiding loop 4 of the hair extension kit, the guiding and holding part 3 of the guiding loop 4 is pulled down to the fastening ring 2 and then the user's hair 12 is drawn down through the fastening ring 2 (shown in FIGS. 3 and 4).

Figure 5:
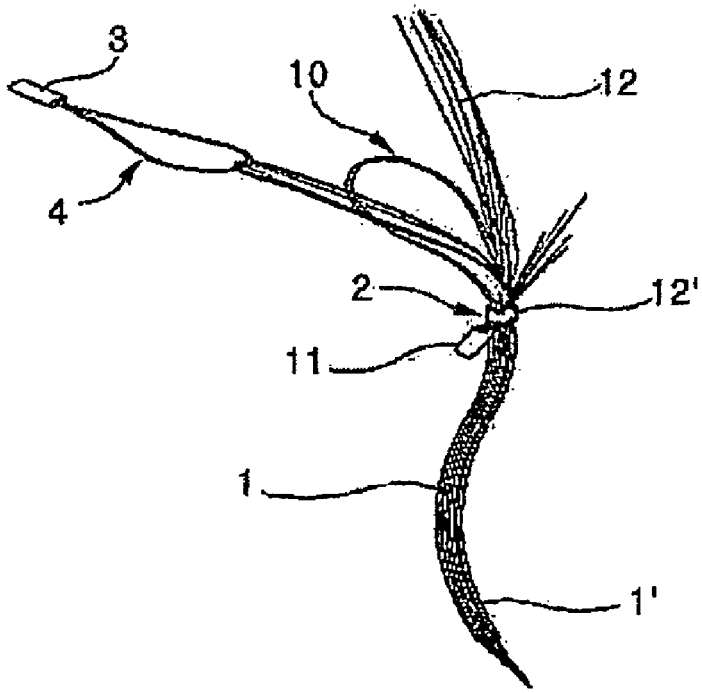

Next, the user's hair 12 is penetrated through the drawing loop 10 using the guiding loop 4 in such a manner that the user's hair 12 can be wrapped around an outer peripheral surface of the fastening ring 2, and then the guiding loop 4 is removed from the user's hair 12 (shown in FIG. 5).

Figure 6:
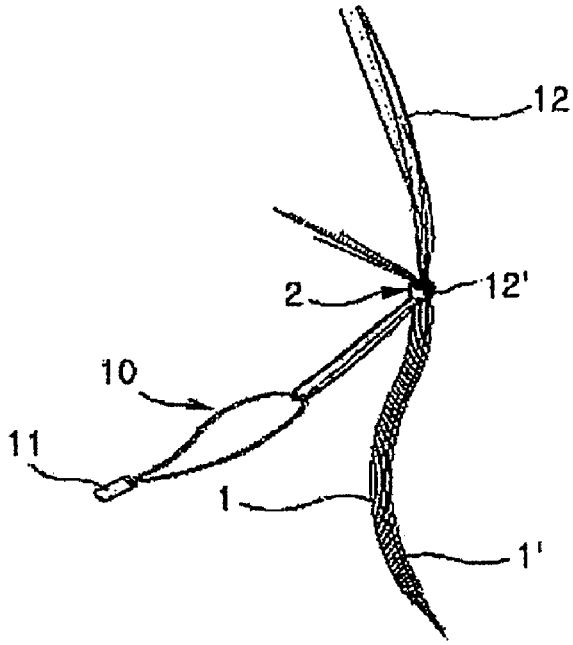

And then, after drawing down the user's hair 12 through the fastening ring 2 using the drawing and holding part 11 of the drawing loop 10, the drawing loop 10 is removed from the user's hair 12 (shown in FIG. 6).

At this time, the user's hair 12 is wrapped around the inner and outer peripheral surfaces of the fastening ring 2, as shown in FIGS. 5 and 6, forming the user's wound hair potion 12'.

Figure 7:
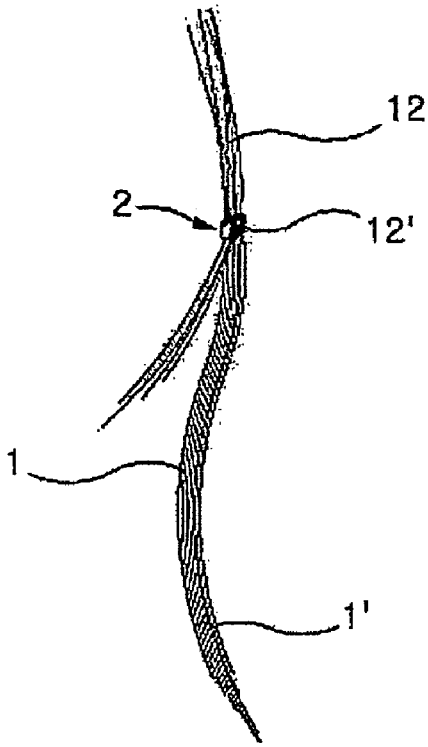

And then, the fastening ring 2 is compressed and deformed using a tool such as a nipper and so on so as to increase the coupling force between the user's hair 12 and the extended hairs 1 and 1' (referring to FIG. 7).

Accordingly, the coupling state of the user's hair and the extended hairs 1 and 1' can be firmly maintained even if a certain degree of oil content of the user's hair 12 is increased or unexpected pulling force is applied to the extended hairs 1 and 1' because the user's hair 12 is wound around the inner and outer peripheral surface of the fastening ring 2 having the extended hairs 1 and 1' attached thereto and the fastening ring 2 is compressed and deformed by the external force.

Figure 8:
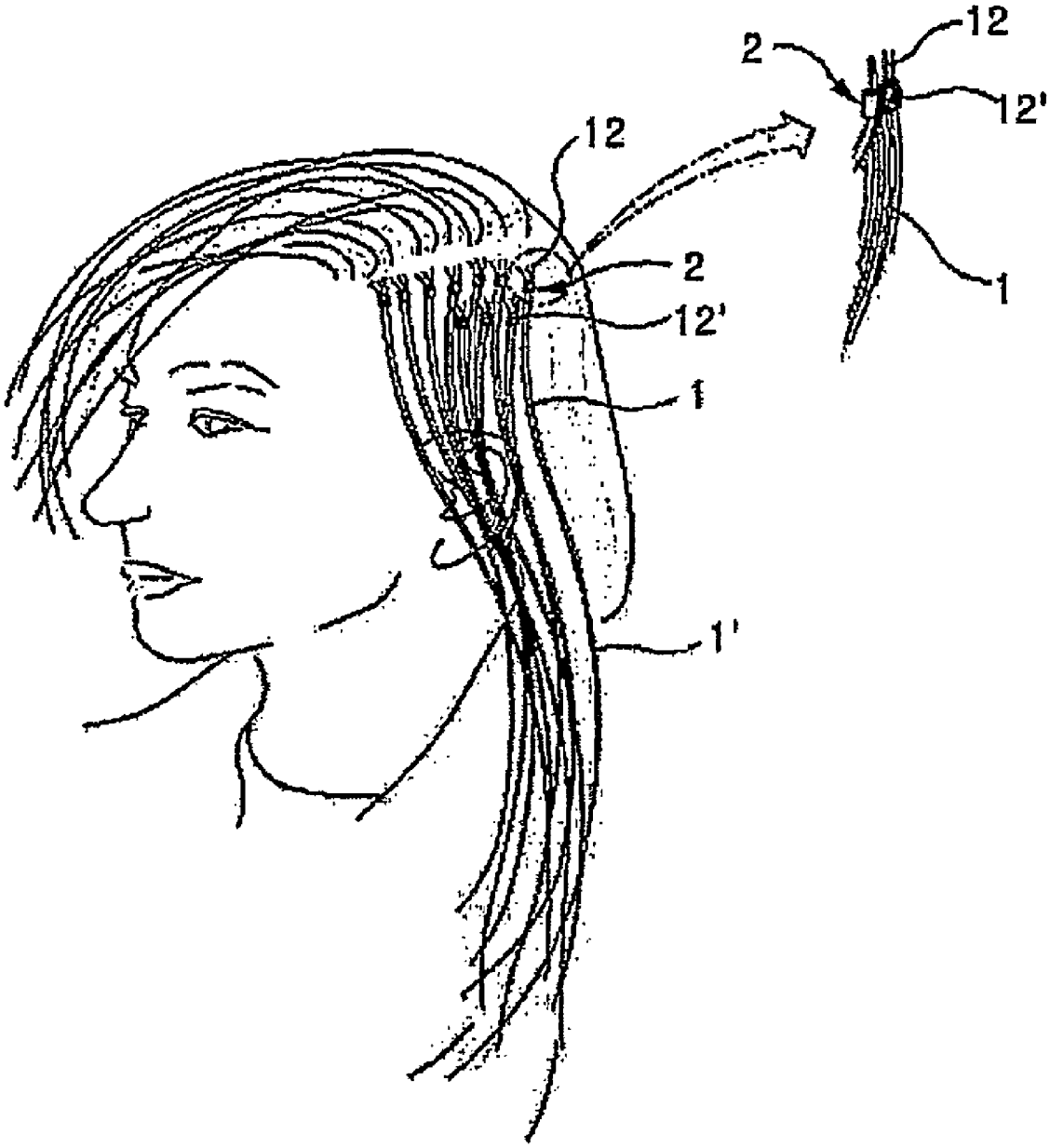
FIG. 8 is a perspective view showing the extension-hair being applied to the user's hair using the hair extension kit according to the present invention.

Next, in the rest of user's hair 12 where the extension-hair will be applied, the coupling procedure is accomplished, as shown in FIG. 8, using the corresponding hair extension kit according to the aforementioned procedure, by allowing the fastening ring 2 having the extended hairs 1 and 1' attached thereto to be coupled with the corresponding user's hair 12 where the extension-hair will be applied in stages, respectively.

Meanwhile, after the application is finished, if user wishes to release the coupling state of the user's hair 12 and the fastening ring 2 having the extended hairs 1 and 1' attached thereto due to the user's hair 12 being sufficiently grown up, or user's demand during use, etc., the user might remove the fastening ring 2 from the user's hair 12 after compressing both longitudinal sides of the compressed fastening ring 2 using a tool such as a nipper and then makes a gap in middle portion thereof.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

INDUSTRIAL APPLICABILITY

As mentioned above, the present invention can increase the coupling force between the user's hair and the extension-hair by means of a fastening ring thereby preventing the extension-hair from slipping down or falling out from the user's hair, even if a physical pull force is applied to the extension-hair or oil content of user's hair is increased.

Furthermore, the present invention can conceal the outside of the fastening ring by winding the user's hair around the inner and outer peripheral surfaces of the fastening ring, thereby rendering a more natural hair style for the extension-hair and the user's hair.

SEQUENCE LISTING

Not Applicable

The invention claimed is:

1. A hair extension kit that couples a user's hair (12) with extended hair (1 and 1'), the hair extension kit comprising:

a plurality of extended hairs (1 and 1'), each of said plurality of extended hairs (1 and 1') having a respective upper end;

a fastening ring (2) formed in a hollow shape, the respective upper end of the extended hairs (1 and 1') being attached to an inner peripheral surface of the fastening ring (2);

a guiding loop (4) having a portion thereof received in the fastening ring (2) and a guiding and holding part (3) formed at a lower end of the guiding loop, the guiding loop (4) being removable from the fastening ring (2); and a drawing loop (10) having a portion thereof received between an inner wall of the fastening ring (2) and a corresponding part of the guiding loop (4) and a drawing and holding part (11) formed at a lower end of the drawing loop (10), the drawing loop (10) being removable from the fastening ring (2).

2. The hair extension kit as claimed in claim 1, wherein the fastening ring (2) is deformable by an external force so as to increase a coupling force between the user's hair (12) and the plurality of extended hairs (1 and 1') in a state that the guiding loop (4) and the drawing loop (10) are removed from the fastening ring (2), respectively.

3. The hair extension kit as claimed in claim 1, wherein a lower portion of the guiding loop (4) and a lower portion of the drawing loop (10) are twisted with a predetermined number of windings.

4. An extension-hair fixing method, comprising the steps of:

inserting a user's hair (12) into a guiding loop (4), and drawing the user's hair (12), downwardly through a fastening ring (2) using a guiding and holding part (3) of the guiding loop (4), the fastening ring (2) having upper ends of extension-hair (1 and 1') attached to an inner peripheral surface of the fastening ring (2);

penetrating the user's hair (12) through a drawing loop (10) in order to allow the user's hair (12) to wrap around an outer peripheral surface of the fastening ring (2) using the guiding loop (4), and removing the guiding loop (4) from the user's hair (12); and drawing down the user's hair (12) through the fastening ring (2) using a drawing and holding part (11) of the drawing loop (10), and removing the drawing loop (10) from the user's hair (12).

5. The extension-hair fixing method as claimed in claim 4, further comprising the step of deforming the fastening ring (2) by an external force so as to increase a coupling force between the user's hair (12) and the extension-hair (1 and 1').

* * * * *